US005826303A

United States Patent [19]

Kellett

[11] Patent Number: 5,826,303

[45] Date of Patent: Oct. 27, 1998

[54] FLEXIBLE CABLE AND DIPNET

[76] Inventor: K. Craige Kellett, RR# 1 Minden, Ontario, Canada, K0M 2K0

[21] Appl. No.: 691,374

[22] Filed: Aug. 2, 1996

[51] Int. Cl.[6] ..... A47B 95/02

[52] U.S. Cl. ..... 16/110 R

[58] Field of Search ..... 16/111 R, 110 R, 16/114 R, 115, 116 R, DIG. 41; 43/11, 18.1, 23; 441/88, 87, 84, 85, 1, 2, 108

[56] References Cited

U.S. PATENT DOCUMENTS

| | | | |
|---|---|---|---|
| 3,768,842 | 10/1973 | Ahlstone | 285/55 |
| 3,847,693 | 11/1974 | Ghersa et al. | 156/79 |
| 4,927,394 | 5/1990 | Galgana | 441/1 |
| 5,480,332 | 1/1996 | Cynamon | 441/80 |

*Primary Examiner*—Chuck Mah

[57] ABSTRACT

A flexible shaft having increased buoyancy and resistance to kinking is disclosed. Further disclosed is a dip net utilizing the flexible shaft whereby the dip net is adapted to be used as an emergency life preserver.

7 Claims, 3 Drawing Sheets

FLEXIBLE CABLE AND DIPNET

The present invention is directed to the art of flexible shafts and dip nets, and to dip nets having more than one function.

BACKGROUND OF THE INVENTION

Prior art shafts having degrees of flexibility are generally provided with mechanical joints at both ends which provide the shaft with its flexibility in use. Few shafts having an inherent flexibility throughout their length are known and, rarer yet, are shafts that are flexible and buoyant. One such shaft is disclosed in U.S. Pat. No. 5,370,434 wherein the flexible shaft forms the extensible portion of a retrieval device.

The art of using dip nets for catching fish has been around since antiquity. Many varied designs and modifications have been made, but each has a handle and a net. Handles have hither to been made from rigid materials such as wood, aluminum tube, or fibreglass and have had the net separately attached. Some of these types of dip net are known to be sufficiently buoyant so as to assist in preventing the loss of the net under water by keeping it somewhat afloat.

SUMMARY OF THE INVENTION

An improved flexible buoyant shaft is disclosed which provides both increased flexibility and greater tensile strength over that of the prior art, while also having greater buoyancy. The present flexible shaft provides the increase in flexibility while further substantially reducing the potential for kinking and subsequent damage the shaft may be exposed to during use. Advantageously utilizing the increased buoyancy of the flexible shaft, there is further disclosed a dip net for use in fishing which, in an emergency, is readily adapted for use as a life saving floatation device. The shaft of the dip net is substantially rigid in shape during normal use, and is readily deformed to a toroidal shape to be used as a life preserver-ring for providing buoyant support to a drowning person and act as a life vest, and when no longer required, readily readapted to its former use as a dip net shaft having a substantially rigid elongate shape. The shaft can of course, also provide emergency buoyancy support in its elongate form as something for a person to cling to, but it is not preferred since the efficacy when used in this form is limited as a person is unable to maintain a grip for extended time periods in cool waters.

Accordingly, there is provided a semi-rigid flexible shaft having increased buoyancy and decreased susceptibility to kinking, the shaft comprising a core formed of a bonded fibreglass rod, a buoyancy layer disposed around the core and formed of a foamed plastic material, a thin aluminum shell swage formed onto the outer surface of the buoyancy layer, and a thin plastic jacket formed on the outer surface of the shell wherein the relative diameters of the core, the buoyancy layer, and the shell thickness are predeterminedly selected with respect to each other.

There is further provided a dip net apparatus adaptable for use as a life preserver, the dip net apparatus comprising a handle formed of a semi-rigid non-resilient elongate shaft having a sheath of buoyant material formed there around, means for releasibly affixing to the shaft a loop portion, and a net attachable to the loop portion, wherein the shaft of the handle is adapted to be deformed under a predetermined stress between a generally linear shape and a generally toroidal shape.

The invention consists in the features of construction, combinations of elements, and arrangement of parts, as exemplified in the construction hereinafter described and of which the scope is indicated by the appended claims.

BRIEF DESCRIPTION OF THE DRAWINGS

An embodiment of the invention will now be described, by way of example, with reference to the accompanying drawings, in which.

DETAILED DESCRIPTION OF THE PREFERRED EMBODIMENTS

Figure 1:
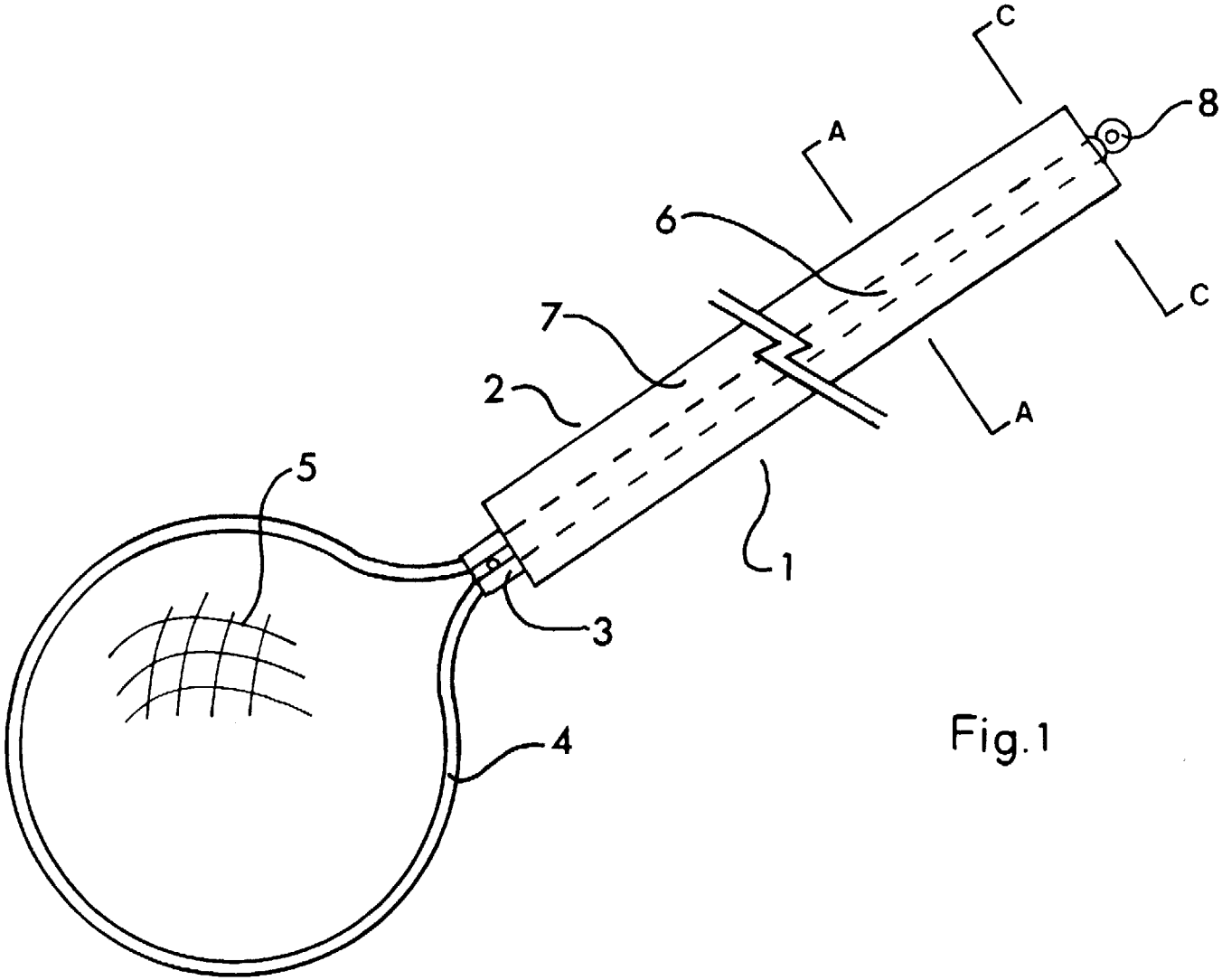
FIG. 1 shows the dip net apparatus of the present invention adapted in a linear shape.
Figure 2:
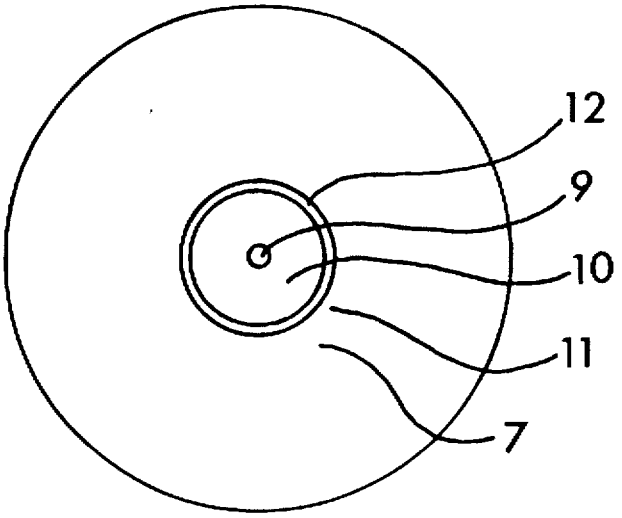
FIG. 2 is a cross-sectional detail of FIG. 1 taken at AA across the handle and showing the flexible shaft.
Figure 4:
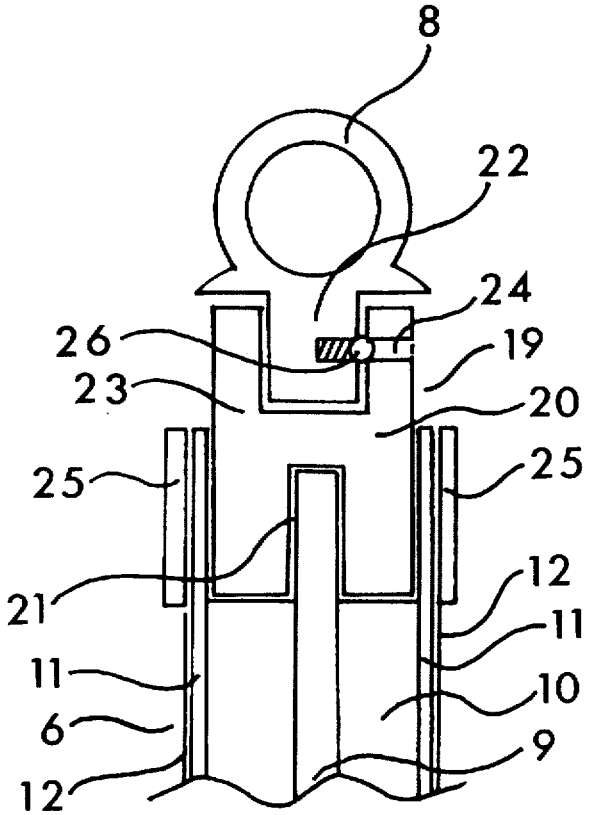
FIG. 4 shows the cross-sectional detail of an optional method of terminating and end of the handle of FIG. 1 taken at CC.

The present device provides a dip net 1, comprising an elongate handle 2 at the distal end of which is disposed via coupling 3 a loop 4 from which depends a net 5. The handle 2 is formed of a deformable, substantially rigid and non-resilient buoyant shaft 6 having disposed around its outside, a sheath 7 formed of a flexible buoyant foam material. The dip net 1 can further be optionally provided with an eye-type loop 8 at the proximate end of the handle 2 to which a rope (not shown) can be attached for pulling the dip net and distressed person to a boat or shore.

The deformable shaft 6 forming the handle 2 comprises a generally coaxial shape having a rod-like core 9 formed of a stiffening member, enveloped by a buoyancy layer 10 of foamed polyethylene or similar light-weight plastic material. The buoyancy layer 10 which is constrained by a tubular flexile member forming a shell 11, onto the surface of which is formed a thin plastic jacket 12. The prior art flexible cable teaches the stiffening member formed of steel. A problem with employing a steel member for the stiffening member is that the steel is limited to a convenient working radius which is in the range of 18" diameter. While the prior art flexible cable can be used down to a working radius of 12", when the radius is tighter than this, long term deformation or kinking of the steel core can occur which prevents the flexible cable from being straightened back out, and can cause the cable to become much harder to use in the prior art device. The present invention recognises that by substitution of the steel core of the flexible shaft for a fibreglass rod, not only is the minimum working radius limitation encountered with the steel core surpassed but, there is further provided enhanced tensile strength at a reduced weight. In a shaft 6 having an external diameter of 0.75", a fibreglass rod in the range of 0.175" diameter, provides both increased flexibility and increased tensile strength. The fibreglass rod core 9 of the present invention is well suited to taking a working radius of down to approximately 6" without long term deformation of the shaft occurring and is accordingly more adaptable in its use. A shaft utilizing the fibreglass core 9 can, in fact, be taken to even tighter radii without deformation, although at that point, the external shell 11 will enter a range of permanent deformation and possible rupture.

The shell 11, which is comprised of a thin metal tube having an inner diameter of 0.620" and a wall thickness of 0.030" in a 0.75" shaft, is preferably formed of aluminum or a similar extrudable metal, and is preferentially swaged onto the outer surface of the buoyant layer 10. While the shell 11 may be formed by welding, residual zones of crystallization and potential flaws are a disadvantage to the flexibility of the shaft since, should they occur at a point where the shaft is required to conform to a somewhat sharper radius, the potential for damage to occur earlier than is otherwise preferable substantially increases. The outer skin or jacket 12 is formed of a flexible tough plastic material such as polyethylene, extruded onto the surface of the shell 11, and has a thickness preferably not less than 0.035 inches. The jacket 12 serves to prevent the shell 11 from dimpling or folding while the shaft 6 is in a tight radius. The buoyant layer 10, preferably comprising a 70% void foamed polyethylene or similar material, provides not only the shaft 6 buoyancy, but provides a portion of the shaft semi-rigidity by acting not only on the core 9, but on the shell 11 as well. The degree of buoyancy, as well as the semi-rigidity, is a function of the degree of void-foaming applied, which will of course depend upon the material used. The diameter of the fibreglass core 9 is selected, on the one hand, as is the wall thickness of the aluminum shell 11, and the radius and compressibility of the toroidal buoyancy layer 10, in combination with the length of the semi-rigid shaft 6, such that in combined effect, there is produced a shaft having a predetermined substantive degree of rigidity during normal use, yet be deformable under a predetermined stress between a normal substantially linear shaft shape and a substantially circular or toroidal shape, resembling that of a life ring. While consideration can be given to the deformation resistance offered by the jacket 12, it is generally minimal in nature and does not appreciably effect the deformability of the shaft 6. When desired for use as a flexible extensible member such as in the prior art, the relative diameter of the core, the diameter and degree of foaming of the buoyant layer, and the thickness of the shell 11 are selected to provide a predetermined degree of substantial flexibility. Because of the increased buoyancy of the improved flexible shaft, a greater degree of control is available to the user when used as an extensible shaft. Because of the combination of the materials selected, as noted above, the shaft 6 is itself not only buoyant, but capable of supporting more than its own weight, and therefor assists in providing positive buoyancy to the handle 2, as well as providing the non-resilient, deformable basis of the handle 2. The outer sheath 7 is formed of a water resistant foam material, such as air-celled polyethylene and other foamed plastics, and is adapted to surround and be bonded to, or formed around the jacket 12 disposed on the exterior of the shaft 6. The buoyancy of the material used for the sheath 7, the length and inherent buoyancy of the shaft 6, taken with respect to the amount of buoyancy desired, substantially determines the outer diameter of the sheath 7. Using a standard foamed cell-air to form the sheath 7, a 48 inch long handle 2 having a sheath 7 exterior diameter of 2.5 inches will support in excess of 125 lbs. A handle 2 that is 72 inches in length will support in excess of 200 lbs. While the handle can be longer than 72 inches, it will be increasing difficult to exert file control in the movement of the handle 2. It should be noted that while the shape of the sheath 7 has been shown as being circular, a shape somewhat more elliptical shape is just as suitable. Depending primarily upon the buoyancy of the material selected for the sheath 7, it may be preferable to provide at least one user hand hold by providing a portion of the sheath 7 with a reduced or restrained diameter so that the handle 2 of the dip net 1 does not become unwieldy in normal use. When two user hand holds are provided, one should be provided towards each end of the handle 2.

Figure 3:
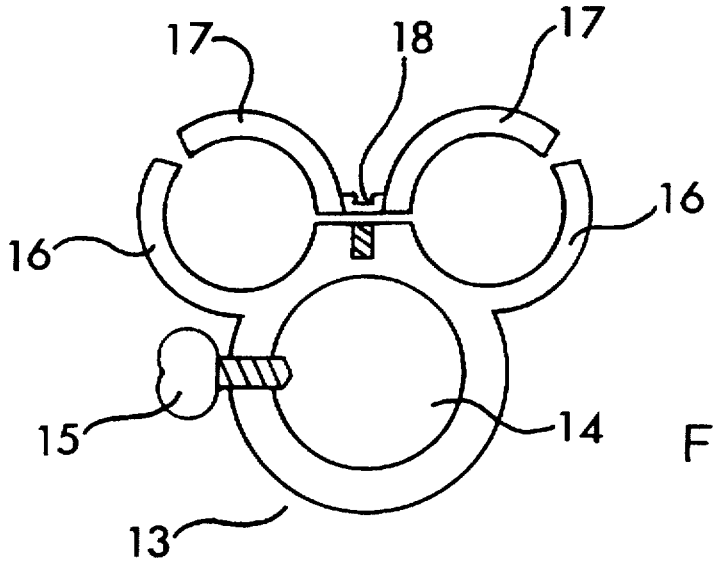
FIG. 3 is a cross-sectional detail of FIG. 1 taken at BB cross the coupling unit of the dip net.

The loop 4, which is adapted to be quickly released from the handle 2 in an emergency, can be formed in the same fashion as the shaft 6, that is, using a semi-rigid shaft. In this case however, the relationship between the stiffening member 9, the flexile member 11, and the buoyant layer 10, is adjusted so as to provide an even more rigid shaft having a smaller diameter. Alternatively, the loop 4 can be formed of a non-buoyant, rigid material such as metal or plastic tube or rod. The loop 4 is adapted to be removably affixed to the shaft 6 by means of a clamp or coupling 3 particularly adapted to allow the user to rapidly release of the loop 4 from the handle 2 when so desired. An exemplary coupling 3, such as shown in FIG. 3, comprises a main coupling body 13 which has a primary chamber 14 adapted to fit substantially size on onto the shaft 6 and is clamped thereto by way of a wing nut 15 or similar means. The loop 4 is attached to the clamp by way of clamp arms 16 which are adapted to springingly engage the ends of the loop 4. A clamp wing 17, secured to the clamp body 13 by way of a mounting stud or screw 18, securely clamps the respective ends of the loop 4 to the clamp body 13. The wing nut 15 is particularly adapted to allow for quick removal of the shaft 6 from the primary chamber 14 when required, without the user requiring any tools. The coupling body 13 and clamp wing 17 are formed of a tensile, substantially lightweight material such as a nylon or similar material, or can be formed from an extruded plastic or aluminum material. The netting 5 is a standard netting adapted for use in a dip net and is employed as such. The loop 7, while shown herein as being circular, can of course be any shape suitable to the task, such as square or rectangular. When being stored, the length of the dip net 1 can be reduced by removing the loop 4 and coupling 3 from the shaft 6 of the handle 2, thus allowing for more convenient user storage.

Figure 5:
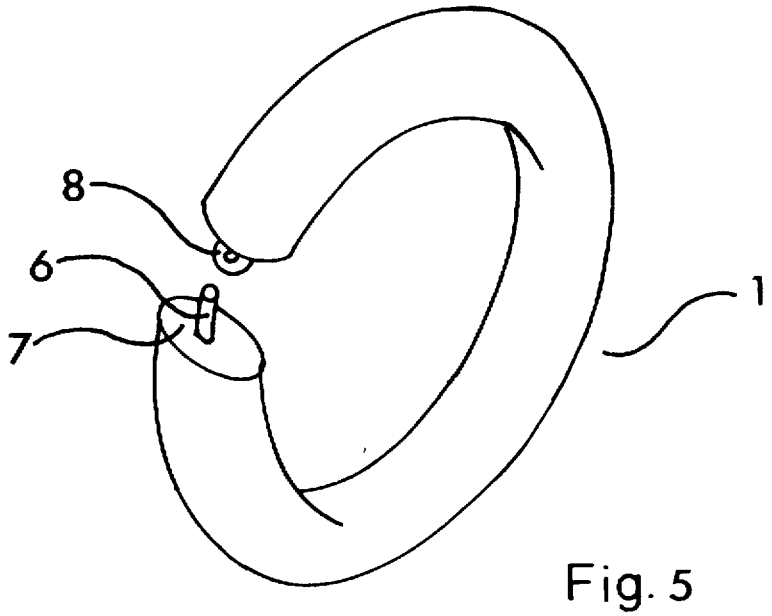
FIG. 5 shows the dip net apparatus adapted to a substantially toroidal shape.

As noted above, the dip net 1 can, if desired, be further provided with an eye-loop 8 so as to allow retrieval of the emergency user to boat or shore by means of a tether or rope (not shown) fastened thereto. FIG. 5 shows a cross-section of one means for fastening the eye-loop 8 to the shaft 6 of the handle 2. The buoyant layer 10 of the shaft 6 is bored out from an end of the shaft for a short distance, preferably leaving the core 9 in place, and the jacket 12 removed approximately the same distance. An end connector 19, comprising an essentially cylindrical stud, is provided at the shaft mating end with a tube 20, the bore 21 of which is chosen to be substantially size on with the diameter of the core 9, and the outer diameter of which is adapted to be received by the shell 11 inner diameter. The other end of the connector 19 is adapted to receive the eye-loop 8 by way of bore 23 adapted to receive a foot 22 of the loop 8. The connector bore 23 is provided with a smaller diameter cross-bore 24 to receive a snap-ball or similar type of release 26 mounted in the foot 22 of the eye-loop 8. The release 26 is adapted to securely engage the cross bore 24 in use, yet allow the eye-loop 8 to be released from the handle 2 when so desired. Alternatively, the foot 22 can be provided with a through-bore in place of the release 26 and be attached by means of a cotterpin or like inserted through the cross-bore 24. When mounting the end connector 19 to the shaft 6, an appropriate adhesive can be employed on respective mating surfaces to attach the end connector 19 to the shaft 6. After being inserted in the end of the shaft 6, the connector 19 can be further mounted to the now bare shell 11 by means of a compression clamp 25 which is swaged onto the shell 11 sufficiently to permanently secure the shell 11 to the tube 21 face of the end connector 19. In an alternative embodiment, the tube 20 is further provided with movable keys, which when under compression applied by the compression clamp 25, act to move inwardly and apply clamping pressure to the core 9. The materials selected for the eye-loop 8, the connector 19 and associated parts are preferably corrosion resistant materials such as nylons, and other plastic materials, as examples, and can also be formed of aluminum. The materials from which they are formed are chosen to provide the required strength in use, but at the lightest possible weight, so as not to hinder the overall buoyant effect of the handle 2. The end connector 19 and eye-loop 8 can be formed and attached to the handle 2 in several ways, the forgoing serving to exemplify one such method. In another embodiment, the eye-loop 8 can be integrally formed with the connector 19.

In normal use, the dip net 1 is used, as is shown in FIG. 1 with the handle 2 in a substantially elongate shape; The shaft 6 is adapted to provide a predetermined substantive resistance to deformation from its linear shape during normal use. During an emergency however, the user can, by removing the loop 4 by way of coupling 3 and placing the handle 2 of the dip net behind his back or around an object, with a predetermined amount of force, deform the handle 2 such that the two ends of the handle 2 can be brought substantially together forming a ring or toroid which a person in distress can put around themselves or cling to. Because of the predetermined stress required to deform the handle 2, a distressed user will generally be unable to apply sufficient stress to substantially deform the handle 2 from its circular shape while in the water. When the emergency is over, the user can restraighten the shaft to its substantially linear form by applying the predetermined required stress to the handle 2, such as by pressing it between two boards or standing on it, and numerous other variations to the same effect, without causing damage to the shaft 6.

It is readily apparent that many uses can be found for the handle 2 in uses other than the dip net alone. The handle 2 can be used to form the handle of a gaff which could then also be used as an emergency life floatation device. Because of the semi-rigid flexibility of the handle 2, in longer sections it could be used as elements of a boom having directional steering capability from a fixed point in that the user could guide the boom around an area rather than having to circle the area as is currently practised.

I claim:

1. A semi-rigid flexible shaft having increased buoyancy and decreased susceptibility to kinking, said shaft comprising:

a core formed of a bonded fibreglass rod;

a buoyancy layer disposed around said core and formed of a foamed plastic material;

a thin aluminum shell swage formed onto the outer surface of the buoyancy layer; and a thin outer plastic jacket disposed on the exterior of said shell;

wherein the relative diameters of the core, the buoyancy layer, and the shell thickness are predeterminedly selected with respect to each other.

2. A shaft as claimed in claim 1 wherein the plastic material of said buoyancy layer comprises void foamed polyethylene.

3. A shaft as claimed in claim 2 wherein said polyethylene is approximately 70% void foamed.

4. A shaft as claimed in claim 1 wherein said aluminum shell is approximately 0.030 inches in thickness.

5. A shaft as claimed in claim 1 wherein said jacket is formed of polyethylene extruded onto the outer surface of said shell.

6. A semi-rigid flexible shaft having increased buoyancy and decreased susceptibility to kinking, said shaft comprising:

a core formed of a bonded fibreglass rod;

a buoyancy layer disposed around said core and formed of a 70% void-foamed polyethylene; and an aluminum shell having a thickness of approximately 0.030 inches swage formed onto the outer surface of the buoyancy layer;

an outer plastic jacket extruded onto the exterior of said shell; and wherein the relative diameters of the core, the buoyancy layer, and the shell thickness are predeterminedly selected with respect to each other.

7. A semi-rigid flexible shaft having increased buoyancy and decreased susceptibility to kinking, said shaft comprising:

a core formed of a bonded fibreglass rod;

a buoyancy layer disposed around said core and formed of a foamed plastic material;

a thin aluminum shell swage formed onto the outer surface of the buoyancy layer;

a thin outer plastic jacket disposed on the exterior of said shell; and a buoyant sheath surrounding the said jacket, said sheath comprising a non-absorbent foamed plastic material.

* * * * *